US006749718B2

(12) United States Patent
Takai et al.

(10) Patent No.: US 6,749,718 B2
(45) Date of Patent: Jun. 15, 2004

(54) WATER-DISINTEGRATABLE SHEET AND MANUFACTURING METHOD THEREOF

(75) Inventors: Hisashi Takai, Kagawa (JP); Takayoshi Konishi, Kagawa (JP)

(73) Assignee: Uni-Charm Corporation, Kawanoe (JP)

( * ) Notice: Subject to any disclaimer, the term of this patent is extended or adjusted under 35 U.S.C. 154(b) by 6 days.

(21) Appl. No.: 10/143,185

(22) Filed: May 10, 2002

(65) Prior Publication Data

US 2003/0000665 A1 Jan. 2, 2003

(30) Foreign Application Priority Data

May 16, 2001 (JP) ..... 2001-146451

(51) Int. Cl.[7] ..... D21F 11/00

(52) U.S. Cl. ..... 162/115; 162/141; 162/146; 162/157.1; 162/158; 162/157.6; 162/109

(58) Field of Search ..... 162/115, 141, 162/146, 157.1, 158, 175, 177, 179, 181.2, 157.6

(56) References Cited

U.S. PATENT DOCUMENTS 5,009,747 A * 4/1991 Viazmensky et al. ..... 162/115
6,306,207 B2 * 10/2001 Cantiani et al. ..... 106/162.8
6,547,927 B1 * 4/2003 Takeuchi et al. ..... 162/115

FOREIGN PATENT DOCUMENTS

JP 11-206611 * 8/1999 ..... A47K/7/00

* cited by examiner

*Primary Examiner*—Peter Chin
*Assistant Examiner*—Mark Halpern
(74) *Attorney, Agent, or Firm*—Darby & Darby

(57) ABSTRACT

Disclosed is a water-disintegratable sheet including water-dispersible fibers and microfibrillated cellulose. The water-dispersible fibers are hydroentangled about each other to provide high fiber density regions and low fiber density regions. The hydroentangled water-dispersible fibers are bonded to each other through a hydrogen bonding power of the microfibrillated cellulose.

8 Claims, 3 Drawing Sheets

WATER-DISINTEGRATABLE SHEET AND MANUFACTURING METHOD THEREOF

BACKGROUND OF THE INVENTION

1. Field of the Invention

The present invention relates to a water-disintegratable sheet which can be used for cleaning article, toilet paper, topsheet or backsheet of absorbent article, packaging sheet for wrapping absorbent article or the like, and a method for manufacturing the same.

2. Description of the Related Art

Wet sheets for wiping discharging parts (e.g., the anus) of the body and toilet papers to be used in dry condition are preferred to be disintegratable (decomposable) in water. In absorbent articles such as sanitary napkin, panty liner, disposable diaper and the like, topsheet for covering the top face of absorbent layer and backsheet for covering the back face of the absorbent layer are preferred to be disintegratable in water. Moreover, packaging sheets for wrapping such absorbent articles are also preferred to be disintegratable in water.

If water-disintegratable sheets are used in such products, they can be disposed of in flush toilet after use When the water-disintegratable sheet is disposed of in flush toilet, a large amount of water is given thereto in the flush toilet or in a septic tank. Therefore, constituent fibers of the water-disintegratable sheet are dispersed in water, thereby preventing the sheet from floating to stay in the septic tank.

Water-disintegratable sheets of this kind are required to maintain a certain strength in use and allow their constituent fibers to disperse when a large amount of water is given thereto.

In order to impart such characteristics, conventional water-disintegratable sheets are typically constructed such that a fiber structure in the form of nonwoven fabric is given a binder for bonding the fibers, such as a water-soluble or water-swellable carboxyl methylcellulose or a water-soluble polyvinyl alcohol. In this water-disintegratable sheet, the sheet strength is obtained by the binder in use, and when a large amount of water is given thereto, the binder is dissolved or swollen to disconnect the fibers.

On the other hand, Japanese Unexamined Patent Publication No. 11-206611 (206611/1999) discloses water-disintegratable tissue paper comprising water-dispersible fibers and microfibrillated cellulose. This water-disintegratable tissue paper is manufactured by blending the water-dispersible fibers and the microfibrillated cellulose in a wet-laid process, followed by drying. In this water-disintegratable sheet, the bonding strength between the water-dispersible fibers can be obtained through a hydrogen bonding power of the microfibrillated cellulose, and when a large amount of water is given thereto, the hydrogen bonding power is reduced to disconnect the water-dispersible fibers.

However, the sheet containing the water-soluble or water-swellable binder needs an additional step of applying such binder, making the production process complicated. In addition, it is not desirable that the sheet containing such binder is brought into direct contact with the skin of the human body. Especially a water-disintegratable sheet to be used in wet condition such as wet tissue is formed such that the foregoing water-disintegratable sheet is impregnated with a liquid containing electrolyte for suppressing dissolving or swelling of the binder in wet condition. However, such electrolyte is undesirable because it may be irritating to the skin.

In the sheet disclosed in Japanese Unexamined Patent Publication No. 11-206611, on the other hand, the water-dispersible fibers are bonded through the strong hydrogen bonding power of the microfibrillated cellulose, and the density of the sheet is increased because of the microfibrillated cellulose present between the water-dispersible fibers. Therefore, the stiffness of the sheet is excessively high in dry condition and the sheet surface is hard. Accordingly, when used as toilet paper, the sheet gives hard feeling to the user's body.

Moreover, when the tissue paper disclosed in the publication is impregnated with a liquid, the hydrogen bonding is weakened to extremely lower the bonding power between the water-dispersible fibers. Therefore, the tissue paper cannot be used in wet condition because of its weak sheet strength.

SUMMARY OF THE INVENTION

The present invention has been worked out in view of the shortcoming in the prior art set forth above. It is therefore an object of the present invention to provide a water-disintegratable sheet which can reduce stiffness and provide softness and in which strength and water-disintegratability can be easily balanced, and a method for manufacturing the same.

According to a first aspect of the present invention, there is provided a water-disintegratable sheet comprising water-dispersible fibers and microfibrillated cellulose, the water-dispersible fibers being hydroentangled about each other to provide high fiber density regions and low fiber density regions, the hydroentangled water-dispersible fibers being bonded to each other through a hydrogen bonding power of the microfibrillated cellulose.

In the water-disintegratable sheet of the present invention, since the high fiber density regions and the low fiber density regions are repeatedly formed by a water-jet treatment, although the water-dispersible fibers are firmly bonded through the hydrogen bonding power of the microfibrillated cellulose, the stiffness of the sheet can be reduced and the sheet can be softened. Moreover, since the sheet strength is obtained by both the hydrogen bonding power of the microfibrillated cellulose and the entanglement with the water-jet treatment, the sheet strength can be maintained even when used in wet condition.

Preferably, the water-disintegratable sheet contains 70 to 95% by weight of water-dispersible fibers and 5 to 30% by weight of microfibrillated cellulose. In this case, the sheet strength and the water-disintegratability can be easily balanced in both dry and wet conditions.

Preferably, the microfibrillated cellulose has a mean fiber length of 0.3 to 1.5 mm and a mean fiber diameter of 0.001 to 0.1 $\mu$m. In this case, the microfibrillated cellulose has a large surface area. Also preferably, the microfibrillated cellulose has a viscosity of 1,000 to 10,000 mPa·s, where 2% by weight of microfibrillated cellulose is mixed with 98% by weight of water. In this case, the microfibrillated cellulose has a dense network structure similar to the cellulose molecule, thereby exhibiting a strong hydrogen bonding power due to an OH group on the surface thereof. Therefore, the water-dispersible fibers can be firmly bonded to increase the sheet strength.

Preferably, the sheet has an average density equal to or less than 0.3 g/cm$^3$. In this case, the stiffness of the sheet can be reduced and the sheet can be made soft. On the other hand, the lower limit of the average density is preferably 0.05 g/cm$^3$.

Preferably, the microfibrillated cellulose is present more in the high fiber density regions than in the low fiber density regions. In the water-disintegratable sheet of the invention, the water-dispersible fibers are gathered and entangled mainly in the high fiber density regions. In the case where the microfibrillated cellulose is collected in these high fiber density regions, the water-dispersible fibers can be sufficiently bonded to each other through the hydrogen bonding power of the microfibrillated cellulose even if the water-dispersible fibers are loosely entangled. Therefore, the sheet strength can be maintained high.

Preferably, the water-dispersible fibers have a fiber length equal to or less than 10 mm and equal to or more than 3 mm. If the fiber length exceeds 10 mm, the water-dispersible fibers will be excessively entangled about each other by water jets, thereby making it difficult for the water-dispersible fibers to be disentangled in water. If the fiber length is below 3 mm, on the other hand, the strength due to entanglement of the water-dispersible fibers can not be expected.

Preferably, the water-dispersible fibers are biodegradable fibers. In this case, the fibers can be biodegraded after dispersion in water, preventing environmental pollution.

Preferably, the square root of the product of the tensile strength in MD and the tensile strength in CD is from 2 to 4 N for 25 mm width, where the water-disintegratable sheet is impregnated with distilled water, which weighs twice as heavy as the sheet. Also preferably, the square root of the product of the tensile strength in MD and the tensile strength in CD is from 4 to 13 N for 25 mm width, where the water-disintegratable sheet is in dry condition. By setting the sheet strength within such ranges, when used as a cleaning article, the sheet can endure a frictional force imparted in wiping operation. On the other hand, when used for an absorbent article, the sheet can maintain the entire shape of the product.

According to a second aspect of the present invention, there is provided a method for manufacturing a water-disintegratable sheet comprising:

blending water-dispersible fibers and microfibrillated cellulose in a wet-laid process to obtain a fibrous web containing the microfibrillated cellulose in an amount of 5 to 30% by weight;

applying water jets to the fibrous web to hydroentangle the water-dispersible fibers about each other and to provide low fiber density regions to which the water jets are applied and high fiber density regions to which fibers removed from the low fiber density regions by the water jets are gathered; and drying the fibrous web to bond the hydroentangled water-dispersible fibers to each other through a hydrogen bonding power of the microfibrillated cellulose.

According to the water-disintegratable sheet manufacturing method of the present invention, the sheet which is soft, strong and easily disintegratable in water can be obtained by using wet-laid process and water-jet treatment which are both widely used in the art.

Preferably, the microfibrillated cellulose has a mean fiber length of 0.3 to 1.5 mm and a mean fiber diameter of 0.001 to 0.1 $\mu$m. Also preferably, the microfibrillated cellulose has a viscosity of 1,000 to 10,000 mPa·s, where 2% by weight of microfibrillated cellulose is mixed with 98% by weight of water.

Preferably, a processing energy of each water jet treatment imparted to the fibrous web with a single row of water-jet nozzles arranged in CD is from 0.05 to 0.5 kw/m$^2$ and the water-jet treatment is performed 1 to 6 times.

By setting the processing energy of the water jet treatment within such ranges, the water-dispersible fibers can be appropriately entangled, maintaining the sheet strength high during use and facilitating disentanglement of the water-dispersible fibers when a large amount of water is given.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment according to the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structure are not shown in detail in order to avoid unnecessary obscurity of the present invention.

Figure 1:
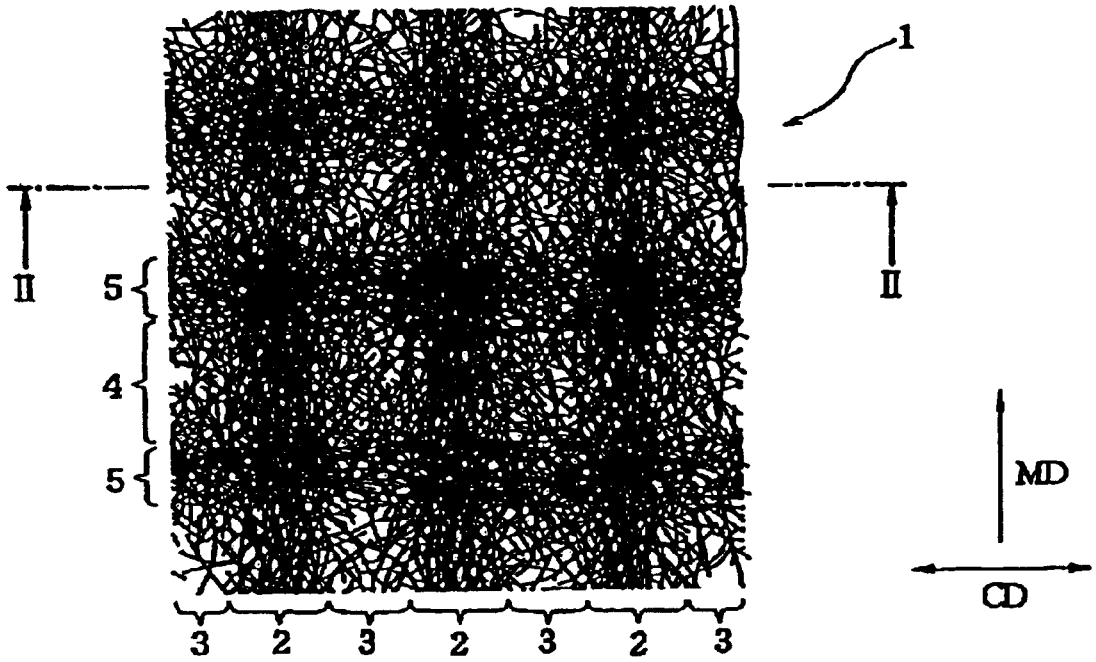
FIG. 1 is a top plan view schematically showing a structure of a water-disintegratable sheet according to one embodiment of the present invention in an enlarged scale.
Figure 2:
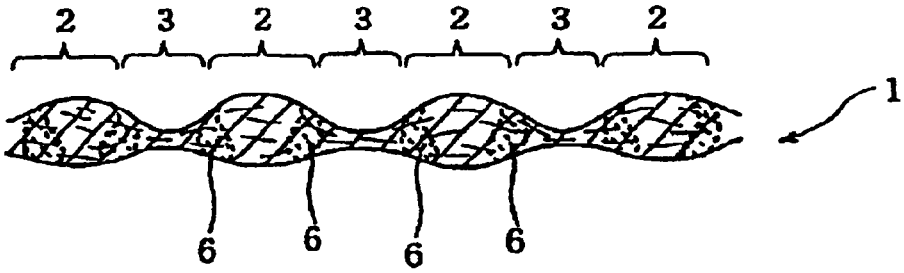
FIG. 2 is a sectional view taken along line II—II of FIG. 1.
Figure 3:
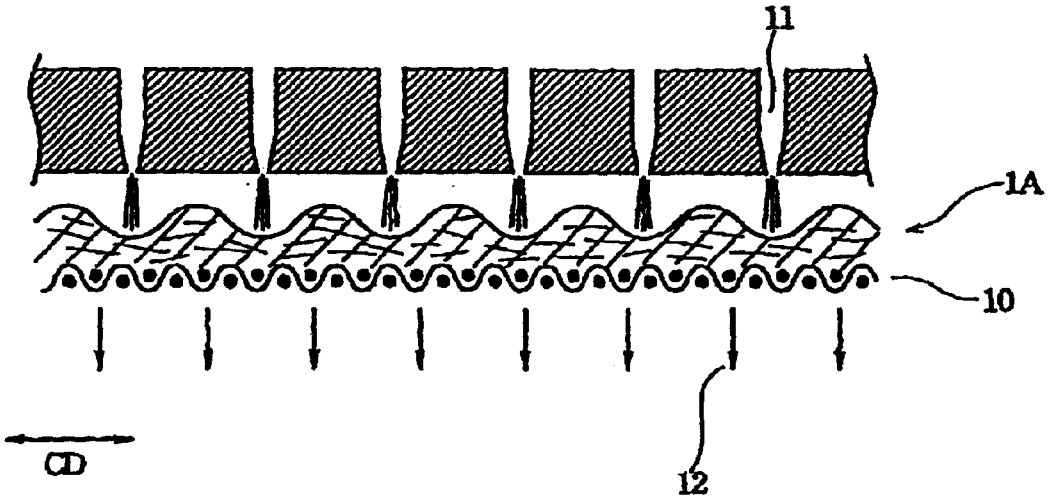
FIG. 3 is a sectional view schematically showing a water-jet treatment.

FIG. 1 is a top plan view schematically showing a structure of a water-disintegratable sheet according to one embodiment of the present invention in an enlarged scale; FIG. 2 is a sectional view taken along line II—II of FIG. 1; and FIG. 3 is a sectional view schematically showing a water-jet treatment.

The water-disintegratable sheet 1 shown in FIGS. 1 and 2 is formed by blending water-dispersible fibers and microfibrillated cellulose in a wet-laid process to form a web, and then subjecting the web to a water-jet treatment.

The term "water-dispersible fibers" as used herein refers to fibers which can be dispersed in water, while keeping their independent fibrous form. Preferably, the water-dispersible fibers employed in the present invention are biodegradable fibers which can be broken down in water or the like by bacteria.

As the water-dispersible fibers, use can be made of chemical fibers or natural fibers only, or a blend of chemical fibers and natural fibers. Chemical fibers include: regenerated fibers such as rayon and acetate; and synthetic fibers such as polypropylene fibers, polyethylene fibers, polyester fibers, bicomponent synthetic fibers of polypropylene and polyethylene and bicomponent synthetic fibers of polyethylene and polyester. Natural fibers include wood pulp such as conifer (softwood) pulp and hardwood pulp, abaca, linter pulp, bamboo pulp and kenaf. Among these fibers, preferably used are the regenerated fibers and the natural fibers since they are biodegradable.

The fiber length of the water-dispersible fibers is preferably equal to or less than 10 mm, more preferably equal to or less than 7 mm. The lower limit of the fiber length is preferably 3 mm. If the fiber length exceeds 10 mm, the water-dispersible fibers are excessively entangled about each other when subjected to water jets, thereby making it difficult to maintain disintegratability in water or making it difficult to set processing conditions of a water-jet treatment appropriately for maintaining disintegratability in water. If the fiber length is less than 3 mm, on the other hand, it becomes difficult for the water-dispersible fibers to entangle about each other, thereby lowering the sheet strength due to the entanglement as well as making it difficult to set processing conditions of a water-jet treatment appropriately.

The fineness of the water-dispersible fibers is preferably from 0.55 to 5.5 dtex. Below the foregoing limit, the fibers are hardly disentangled in water because they are excessively thin, thereby deteriorating water-disintegratability. Above the foregoing limit, the water-dispersible fibers are hardly entangled about each other when subjected to water jets because they are excessively thick, thereby lowering the strength of the water-disintegratable sheet. If the fibers are excessively thick, moreover, the sheet surface becomes rough, thereby deteriorating the hand (feel).

For the water-dispersible fibers, it is preferred to blend rayon as the regenerated fibers and conifer pulp as the natural fibers. The conifer pulp itself has a hydrogen bonding power due to an OH group on the surface thereof. Moreover, since the conifer pulp has a mean fiber length as small as 1.0 to 4.5 mm, fiber dispersion will start at portions containing the conifer pulp when the water-disintegratable sheet is given to a large amount of water, thereby facilitating the disintegration of the sheet. The conifer pulp is preferred to have a Canadian Standard Freeness (CSF) of 400cc to 750 cc (measured value based on JIS P-8121). If the CSF is less than 400 cc, i.e., the pulp is excessively beaten, the hand of the nonwoven fabric will deteriorate. More preferred range of the CSF is from 500 cc to 750 cc. As the conifer pulp, preferably used is conifer bleached kraft pulp (NBKP).

The term "microfibrillated cellulose" as used herein refers to cellulose comminuted and beaten to near microfibril. Such microfibrillated cellulose can be produced, for example, by employing pulp as a starting material, performing a special mechanical process thereto under condition of an aqueous suspension, and extremely beating it while suppressing cut along fiber axis direction. The microfibrillated cellulose is given the shape of an elongated fiber. In the present invention, it is preferred that the mean fiber length of the microfibrillated cellulose is 0.3 to 1.5 mm and the mean fiber diameter thereof is 0.001 to 0.1 $\mu$m.

The microfibrillated cellulose (microfibril) is a minute, water-insoluble fiber. Since the surface area of the microfibrillated cellulose is about 190 times that of pulp, the microfibrillated cellulose can exhibit a strong hydrogen bonding power due to an OR group on the surface thereof, by drying it after once wetted. The microfibrillated cellulose itself has a dense network structure similar to the cellulose molecule. When subjected to a water-jet treatment, the microfibrillated cellulose itself is entangled. Moreover, the microfibrillated cellulose enters the entangled interface between the water-dispersible fibers entangled through the water-jet treatment, to further increase the bonding strength between the entangled water-dispersible fibers.

The microfibrillated cellulose is insoluble in water, and is in paste form having a viscosity when it is mixed with water. The microfibrillated cellulose employed in the present invention is preferred to have a viscosity of 1,000 to 10,000 mPa·s,where 2% by weight of microfibrillated cellulose is mixed with 98% by weight of distilled water into paste form. More preferably, the viscosity is from 4,000 to 8,000 mPa·s. The microfibrillated cellulose having the viscosity within such range has a mean fiber diameter of about 0.001 to 0.1 $\mu$m. Therefore, it can enter the entangled interface of the water-dispersible fibers to effect the function of strongly bonding the water-dispersible fibers by its hydrogen bonding power.

Here, the viscosity was determined at 25° C. using a type B viscometer, wherein the rotor number was 4, and the rotational speed of rotor was 30 rpm.

In addition, the hydrogen bonding power for bonding the water-dispersible fibers can be increased by employing microfibrillated cellulose having a higher water retentivity. The microfibrillated cellulose employed in the present invention is preferred to have a water retentivity of at least 250% according to JAPAN TAPPI Paper and Pulp Test Method No. 26.

In the present invention, the water-disintegratable sheet preferably contains 70–95% by weight of water-dispersible fibers and 5–30% by weight of microfibrillated cellulose. If the content of the microfibrillated cellulose is less than 5% by weight, it is difficult to provide sufficient sheet strength due to hydrogen bonding of the microfibrillated cellulose. If the content of the microfibrillated cellulose exceeds 30% by weight, the freeness of the blend of the water-dispersible fibers and the microfibrillated cellulose is decreased. Therefore, when the blend is formed into a fibrous web in a wet-laid process, it is difficult to uniformly distribute the water-dispersible fibers land the microfibrillated cellulose throughout the fibrous web.

The water-disintegratable sheet of the present invention can be manufactured as follows.

The water-dispersible fibers and the microfibrillated cellulose blended in water are fed onto a wire of a cylinder mould or a wire moving in an inclined position, thereby to form a fibrous web on the wire from the blended material. Here, the term "wire" as used in the foregoing web forming refers to a mesh conveyor belt of plastic or metal wires coated with a plastic material.

After a fibrous web 1A in which the water-dispersible fibers and the microfibrillated cellulose are blended, is thus formed on a wire 10, jets of water are applied from water-jet nozzles 11 to the fibrous web 1A, as shown in FIG. 3. At this time, preferably, the fibrous web 1A is drawn to the wire 10 by sucking air on the side opposite from the nozzles 11, as indicated at 12.

In such water-jet treatment, processing conditions are preferably set to appropriately entangle the water-dispersible fibers about each other so that the sheet strength and the water-disintegratability of the water-disintegratable sheet 1 can be well-balanced. To this end, it is preferred that the water-jet nozzles 11, which are arranged in the cross direction (CD) as shown in FIG. 3, have a nozzle diameter of 75 to 120 $\mu$m and an arrangement pitch of 0.3 to 2 mm in CD.

It should be noted that if the arrangement pitch in CD is small, the water-jet nozzles can be arranged such that nozzles adjacent to each other in CD are staggered in the machine direction (MD) and do not overlap with each other as viewed from MD. If the arrangement pitch in CD is large, on the other hand, the nozzles can be aligned in CD. In this specification, both the nozzles thus staggered in MD without overlapping and the nozzles thus aligned in CD are defined as a single row of nozzles. In the case where the nozzles are staggered, as set forth above, the arrangement pitch refers to a pitch assuming that the nozzles are aligned in CD.

Each time the water-jet treatment is performed with the single row of water-jet nozzles 11 staggered or aligned, water jets preferably impart to the fibrous web 1A a processing energy of 0.05 to 0.5 kw/m$^2$. The water-jet treatment with such water-jet nozzles 11 is performed on the fibrous web 1A 1 to 6 times, preferably 2 to 4 times.

If the nozzle diameter of the water-jet nozzles 11 is below the foregoing limit, there is a possibility of clogging the nozzles. If it exceeds the foregoing limit, it is difficult to adjust the processing energy within the foregoing range. If the arrangement pitch of the nozzles is less than the foregoing limit, on the other hand, the processing energy per unit area of the fibrous web 1A is increased, so that it becomes difficult to maintain bulk of the sheet. If it exceeds the foregoing limit, the degree of entanglement of the water-dispersible fibers is lowered, so that sufficient sheet strength can not be obtained. In this case, moreover, it is impossible to provide the sheet with much difference in density, so that softness of the sheet is reduced.

FIG. 1 schematically shows the structure of the water-disintegratable sheet 1 after subjected to the water-jet treatment. With water jets being applied from the water-jet nozzles 11, the water-disintegratable sheet 1 is provided with regions 3 extending in the machine direction (MD). Fibers in the region 3 are moved in CD by the processing energy of the water jets. As a result, between adjacent regions 3 and 3, there are formed high fiber density regions 2, to which the fibers moved from the regions 3 with the water jets are gathered. Moreover, in each region 3, low fiber density regions 4 alternate in MD with high fiber density regions 5 connecting adjacent high fiber density regions 2 and 2 to each other. The fiber density is higher in the regions 2 and 5 than in the regions 4. The fiber density of the regions 2 may be either higher or lower than that of the regions 5. The difference in density between the regions 2 and 5 depends on the network pattern of the wire 10, the processing energy of the water-jet treatment, the fiber length and so on.

The arrangement pitch of the high density regions 2 in CD coincides with the foregoing arrangement pitch of the water-jet nozzles 11. Therefore, the arrangement pitch of the high density regions 2 in CD is in a range from 0.3 to 2 mm.

With the water-jet treatment, the water-dispersible fibers are moved in CD and MD from the regions 3 and mainly entangled about each other in the high fiber density regions 2 and 5. The microfibrillated cellulose is also entangled about each other and enters the interface between the water-dispersible fibers. Here, with the pressure of the water-jet treatment, the microfibrillated cellulose tends to assemble in the portions indicated at 6 in FIG. 2. Such portions 6 are located on two side portions of the individual high fiber density regions 2 and 5. More specifically, in the individual portions 6, the microfibrillated cellulose tends to assemble more on the side close to the wire 10 in the thickness direction of the sheet. Therefore, the microfibrillated cellulose is present more in the regions 2 and 5 than in the regions 4.

After the water-jet treatment, the hydroentangled web is dried. In the water-disintegratable sheet 1 after dried, the microfibrillated cellulose exhibits a strong hydrogen bonding power due to the OH group on the surface thereof, to firmly bond the water-dispersible fibers to each other.

For the water-disintegratable sheet 1, it is preferred to blend 70 to 95% by weight of water-dispersible fibers and 5 to 30% by weight of microfibrillated cellulose. The basis weight of the water-disintegratable sheet 1 is 10 to 100 g/m$^2$, preferably 30 to 80 g/m$^2$. If the basis weight is less than the foregoing limit, the strength of the water-disintegratable sheet 1 is lowered, so that it can not exhibit a sufficient strength when used as a cleaning article for wiping operation, a topsheet or backsheet of an absorbent article or a packaging sheet for wrapping an absorbent article. If the basis weight exceeds the foregoing limit, the softness of the water-disintegratable sheet 1 is deteriorated.

By setting the processing conditions of the water-jet treatment as set forth above, the average density of the water-disintegratable sheet 1 can be set within a preferred range from 0.3 to 0.05 g/cm$^3$. The average density is more preferably equal to or less than 0.2 g/m$^3$, most preferably equal to or less than 0.15 g/m$^3$. The lower limit of the average density is more preferably 0.08 g/m$^3$. By setting the average density within the foregoing range, the stiffness is lowered to provide the water-disintegratable sheet 1 with a soft feeling.

In the water-disintegratable sheet 1, the entanglement of the water-dispersible fibers also contributes to the sheet strength, in addition to the hydrogen bonding through the microfibrillated cellulose. Therefore, even in wet condition, the sheet strength can be maintained. When the water-disintegratable sheet 1 is impregnated with distilled water which weighs twice as heavy as the sheet, the square root of the product of the tensile strength in MD and the tensile strength in CD is from 2 to 4 N for 25 mm width (details of the measuring method will be found in the following Examples as well as other various characteristics). When the water-disintegratable sheet 1 is in dry condition, the square root of the product of the tensile strength in MD and the tensile strength in CD is from 4 to 13 N for 25 mm width.

When the water-disintegratable sheet 1 which can exhibit strength in both wet and dry conditions as set forth above, is disposed of in a flush toilet and given a large amount of water in the flush toilet or in a septic tank, the hydrogen bonding power of the microfibrillated cellulose is weakened and the water-dispersible fibers are disentangled, so that the fibers are dispersed in water.

The water-disintegratable sheet 1 thus obtained is preferred to have a water-disintegratability equal to or less than 100 seconds. On the other hand, it is preferred to have a stiffness within a range of 4.5 to 7 mm, as measured by the cantilever method in dry condition.

In the water-disintegratable sheet 1, the sheet strength and the water-disintegratability can be well-balanced as set forth above even without adding any water-soluble or water-swellable binder. However, if the sheet strength is required to be further increased depending on applications of the water-disintegratable sheet 1, it is possible to apply a binder such as carboxyl methylcellulose or polyvinyl alcohol onto the sheet surface.

When the water-disintegratable sheet 1 is used as a cleaning article such as wet tissue or wet wipe, the liquid to be impregnated into the water-disintegratable sheet 1 may contain a surfactant, a disinfectant, a preservative, an alcohol, a perfume material and the like, according to demand.

The water-disintegratable sheet 1 may be of a single layer structure or a multi-layer structure depending on applications. In case of the multi-layer structure, a first fibrous web is formed on the wire 10 of FIG. 3 in a wet-laid process, and a second fibrous web is formed on the first fibrous web in a wet-laid process. Such operation is repeated, if necessary, to form a multi-layer structured fibrous web. This fibrous web is subjected to the water-jet treatment.

Here, the individual fibrous webs may be formed from the same material in which the water-dispersible fibers and the microfibrillated cellulose are blended. In an alternative, it is possible to form one or more fibrous webs from the blend of the water-dispersible fibers and the microfibrillated cellulose and to form the remaining fibrous web(s) from the water-dispersible fibers only. In another alternative, the content of the microfibrillated cellulose may be different for different fibrous webs.

Figure 4A:
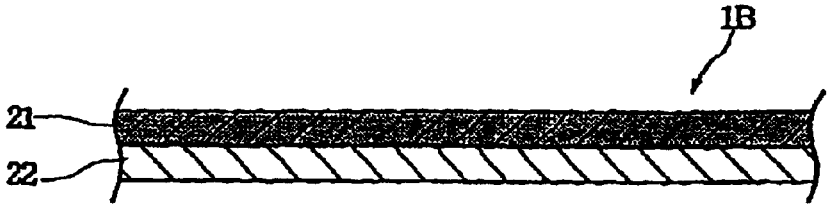
FIGS. 4A, 4B and 4C are sectional views showing exemplary layered structures of water-disintegratable sheets.
Figure 4B:
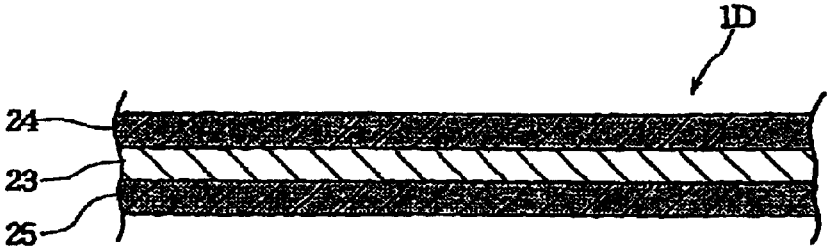
Figure 4C:
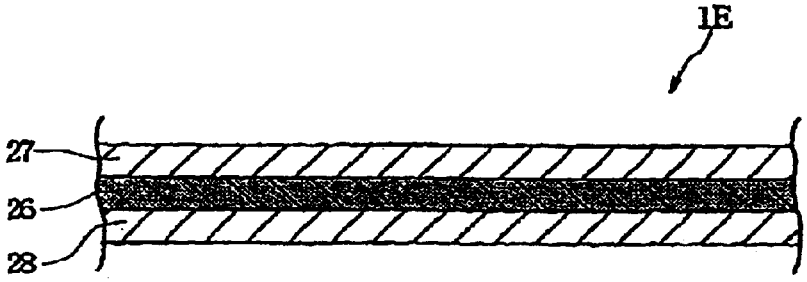

For instance, FIG. 4A shows a water-disintegratable sheet 1B in which one layer 21 contains the microfibrillated cellulose and the other layer 22 exhibits its sheet strength mainly by the entanglement of the water-dispersible fibers. On the other hand, FIG. 4B shows a water-disintegratable sheet 1D in which an intermediate layer 23 exhibits its sheet strength mainly by the entanglement of the water-dispersible fibers and both top and back layers 24 and 25 contain the microfibrillated cellulose to increase the surface strength of the sheet. On the other hand, FIG. 4C shows a water-disintegratable sheet 1E in which only an intermediate layer 26 contains the microfibrillated cellulose and both top and back layers 27 and 28 are strengthened mainly by the entanglement of the water-dispersible fibers.

Even such multi-layer structured water-disintegratable sheets, in which at least one layer contains the microfibrillated cellulose in a sufficient amount and the other layer(s) consists of the hydroentangled water-dispersible fibers or contains the microfibrillated cellulose in a smaller amount, can maintain the sheet strength as a whole. When a large amount of water is given thereto, the fiber dispersion can be started in the layer(s) containing no or a small amount of microfibrillated cellulose, thereby making it possible to enhance the water-disintegratability of the entire sheet.

EXAMPLES

The following are examples of the present invention. However, it is to be understood that the present invention should not be limited to the examples.

Water-Dispersible Fiber

Conifer bleached kraft pulp (NBKP) beaten with a pulper to set the Canadian Standard Freeness (CSF) to 740 cc and rayon having a fineness of 1.1 dtex and a mean fiber length of 5 mm (tradename "CORONA" commercially available from Daiwabo Rayon, Japan) were blended for use.

Microfibrillated Cellulose

Microfibrillated cellulose commercially available from Daicel Chemical Industries, Ltd., Japan under tradename "CELLISH KY-100G type" was used. This microfibrillated cellulose was obtained by beating pulp to microfibril having a mean fiber diameter of about 0.01 $\mu$m. When a mixture of 2% by weight of microfibrillated cellulose and 98% by weight of distilled water was formed and measured at 25° C. using a type B viscometer (rotor No. 4) having a rotor rotational speed of 30 rpm, the viscosity was 6,000 mPa·s.

Fibrous Web

The water-dispersible fibers and the microfibrillated cellulose were blended in a wet-laid process to prepare fibrous webs for Comparative Examples 1 to 7 and Examples 1 to 5. The blending ratios (% by weight) of NBKP, rayon and microfibrillated cellulose are found in Table 1.

The wet-laid process was such that materials were suspended in water to a concentration of 0.02% by weight, and collected to from a fibrous web having a size of 25×25 cm onto a papermaking 90 mesh wire.

Comparative Example

For Comparative Examples 1 to 6 of Table 1, the fibrous webs thus formed into a size of 25×25 cm were dried at 150° C. for 90 seconds by means of a rotary drum dryer, without subjected to a water-jet treatment.

For Comparative Example 7, on the other hand, the fibrous web containing no microfibrillated cellulose (see Table 1) was subjected to a water-jet treatment, which is the same as that for Example, in wet condition after formation.

Example

For Examples 1 to 5 (and for Comparative Example 7), the fibrous webs after formation into a size of 25×25 cm were treated with jets of water delivered from water-jet nozzles in wet condition. The nozzle diameter of the water-jet nozzles was 100 $\mu$m, and three rows of water-jet nozzles were arranged in MD, in each row of which, the water-jet nozzles were arranged at a pitch of 0.5 mm in CD.

The fibrous web was moved in MD at a speed of 30 m/min and the hydraulic pressure from each nozzle was set at 3,920 kPa, so that the processing energy given to the fibrous web from the three rows of water-jet nozzles was 0.4 kw/m$^2$.

After the water-jet treatment, the fibrous webs were dried at 150° C. for 90 seconds by means of a rotary drum dryer, to obtain water-disintegratable sheets.

Measuring Method (1) Basis Weight, Thickness and Density of Sheet

According to specified conditions described in "Humidity Conditioning and Standard State for Test" of JIS P-8111, the temperature was set at 20±2° C. and the, relative humidity was set at 65±2%. After standing in such environment for at least 30 minutes, the basis weight, thickness and density were measured for the individual sheets.

(2) Water-Disintegratability

The water-disintegratability was measured according to the test method described in "4.5 Easiness of Disentanglement" of "Toilet Paper" of JIS P-4501. However, it should be noted that the sheet size of the sample was set at 10×10 cm, and this sample was put in a 300 ml beaker filled with 300 ml of ion-exchanged water, followed by stirring. The stirring was performed with a rotor set at a rotational speed of 600±10 rpm, and the sample in the beaker was visually observed to determine the time required for the sample to be completely disintegrated since the stirring was started. "Water-disintegratability" is expressed on the second time scale (sec) in Table 1.

(3) Dry Strength

The sheets for Comparative Examples and Examples in dry condition were cut to form rectangular samples, of which the short side was 25 mm and the long side was 150 mm, and then allowed to stand for at least 30 minutes in the same environment as that for measuring the basis weight, thickness and density. Thereafter, the short sides of the sample were held by chucks of a Tensilon tester. With an initial chuck-to-chuck distance set at 100 mm, the sample was stretched at a tensile rate of 100 mm/min. The maximum load measured by the tester was determined as a measured value. For respective Comparative Examples and Examples, a sample having its long side extending along MD of the sheet and a sample having its long side extending along CD of the sheet were prepared and tested as set forth above, in which the square root of {(measured valued in MD)×(measured value in CD)} was determined as a dry strength. Other test conditions were based on JIS P-8135.

(4) Wet Strength

For respective Comparative Examples and Examples, a 25×150 mm sample having its long side extending along MD of the sheet and a 25×150 mm sample having its long side extending along CD of the sheet were prepared, impregnated with distilled water in an amount twice the weight of the sample, sealed in a plastic bag, and allowed to stand for 24 hours in an environment of 20±220 C. Thereafter, the samples were taken out and immediately tested in the same manner as that for measuring the dry strength, in which the square root of {(measured valued in MD)×(measured value in CD)} was determined as a wet strength.

(5) Stiffness

For respective Comparative Examples and Examples, a sample having a short side (25 mm) extending along CD of the sheet and a long side (150 mm) extending along MD of the sheet was prepared, and after standing in the same environment as that for measuring the basis weight and soon, tested according to "8.19 Stiffness (Cantilever Method: Method A)," of JIS L-1096. In this test, the individual sample was tested for both sides. The square root of the product of the value measured with one side of the sample directed upward and the value measured with the other side directed upward was determined as a measured value.

Table 1 shows the individual measured values.

TABLE 1

| | | Com. Ex. 1 | Com. Ex. 2 | Com. Ex. 3 | Com. Ex. 4 | Com. Ex. 5 | Com. Ex. 6 |
|---|---|---|---|---|---|---|---|
| NBKP (Degree of Beating: 740 cc) | | 70 | 65 | 55 | 50 | 45 | 40 |
| 1.1 dtex * 5 mm Rayon | | 30 | 30 | 30 | 30 | 30 | 30 |
| Microfibrillated cellulose | | — | 5 | 15 | 20 | 25 | 30 |
| Basis weight | g/m$^2$ | 40.0 | 40.0 | 40.0 | 40.0 | 40.0 | 40.0 |
| Thickness | mm | 0.12 | 0.12 | 0.11 | 0.11 | 0.11 | 0.10 |
| Density | g/cm$^3$ | 0.33 | 0.33 | 0.36 | 0.36 | 0.36 | 0.40 |
| Water Disintegratability | sec | 5 | 25 | 38 | 58 | 86 | 91 |
| Dry strength | N/25 mm | 6.42 | 14.9 | 31.9 | 37.7 | 40.3 | 43.1 |
| Wet strength | N/25 mm | 0.69 | 1.53 | 1.98 | 2.38 | 2.46 | 2.64 |
| Stiffness | mm | 6.5 | 8.1 | 12.6 | 13.2 | 11.6 | 12.8 |

| | | Com. Ex. | 7 Ex. 1 | Ex. 2 | Ex. 3 | Ex. 4 | Ex. 5 |
|---|---|---|---|---|---|---|---|
| NBKP (Degree of Beating: 740 cc) | | 70 | 65 | 55 | 50 | 45 | 40 |
| 1.1 dtex * 5 mm Rayon | | 30 | 30 | 30 | 30 | 30 | 30 |
| Microfibrillated cellulose | | — | 5 | 15 | 20 | 25 | 30 |
| Basis weight | g/m$^2$ | 40.0 | 40.0 | 40.0 | 40.0 | 40.0 | 40.0 |
| Thickness | mm | 0.42 | 0.41 | 0.40 | 0.39 | 0.39 | 0.38 |
| Density | g/cm$^3$ | 0.0952 | 0.0976 | 0.10 | 0.1026 | 0.1026 | 0.1053 |
| Water Disintegratability | sec | 9 | 29 | 45 | 63 | 91 | 95 |
| Dry strength | N/25 mm | 1.39 | 4.17 | 9.11 | 11.63 | 11.86 | 12.96 |
| Wet strength | N/25 mm | 0.93 | 2.17 | 2.95 | 3.55 | 3.68 | 3.93 |
| Stiffness | mm | 4.2 | 4.8 | 5.3 | 5.5 | 5.7 | 6.1 |

As has been described above, in the water-disintegratable sheet of the present invention, the sheet strength is obtained by both the hydrogen bonding power of the microfibrillated cellulose and the entanglement of the water-dispersible fibers. Moreover, when a large amount of water is given thereto, the water-disintegratable sheet can be disintegrated in water due to weakening of the hydrogen bonding power and disentanglement of the fibers. Therefore, the sheet strength and the water-disintegratability can be easily balanced. In addition, the sheet can exhibit a sufficient strength even when used in wet condition.

Moreover, with the high fiber density regions and the low fiber density regions being formed therein, the sheet has a low stiffness as a whole and the sheet surface is also soft. Therefore, when used as a cleaning article such as wet tissue, soft feeling can be provided to the touch. When used as a topsheet or backsheet of an absorbent article or a packaging sheet for wrapping the absorbent article, on the other hand, the entire product can be made soft due to softness of the sheet.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. A water-disintegratable sheet comprising 70 to 95% by weight of water-dispersible fibers having a fiber length equal to or less than 10 mm and 5 to 30% by weight of microfibrillated cellulose having a mean fiber length of 0.3 to 1.5 mm and a mean fiber diameter of 0.001 to 0.1 $\mu$m, the water-dispersible fibers including conifer pulp and rayon and hydroentangled about each other to provide high fiber density regions and low fiber density regions, the hydroentangled water-dispersible fibers being bonded to each other through a hydrogen bonding power of the microfibrillated cellulose, wherein the sheet has an average density equal to or less than 0.3 g/cm$^3$, a basis weight of 10 to 100 g/m$^2$, a water-disintegratability equal to or less than 100 seconds, a stiffness of 4.5 to 7 mm when dry, a wet strength of 2 to 4 N for a width of 25 mm, and a dry strength of 4 to 13 N for the width of 25 mm.

2. A water-disintegratable sheet as set forth in claim 1, wherein the microfibrillated cellulose has a viscosity of 1,000 to 10,000 mPa·S, where 2% by weight of microfibrillated cellulose is mixed with 98% by weight of water.

3. A water-disintegratable sheet as set forth in claim 1, wherein the microfibrillated cellulose is present more in the high fiber density regions than in the low fiber density regions.

4. A water-disintegratable sheet as set forth in claim 1, wherein the sheet is composed of two or more layers between which the microfibrillated cellulose content differs.

5. A method for manufacturing a water-disintegratable sheet comprising:

blending 70 to 95% by weight of water-dispersible fibers including conifer pulp and rayon and 5 to 30% by weight of microfibrillated cellulose having a mean fiber length of 0.3 to 1.5 mm and a mean fiber diameter of 0.001 to 0.1 $\mu$m in a wet-laid process to obtain a fibrous web;

applying water jets to the fibrous web to hydroentangle the water-dispersible fibers about each other and to provide low fiber density regions to which the water jets are applied and high fiber density regions to which fibers removed from the low fiber density regions by the water jets are gathered; and drying the fibrous web to bond the hydroentangled water-dispersible fibers to each other through a hydrogen bonding power of the microfibrillated cellulose, wherein the sheet has an average density equal to or less than 0.3 g/cm$^3$, a basis weight of 10 to 100 g/m$^2$, a water-disintegratability equal to or less than 100 seconds, a stiffness of 4.5 to 7 mm when dry, a wet strength of 2 to 4 N for a width of 25 mm, and a dry strength of 4 to 13 N for the width of 25 mm.

6. A water-disintegratable sheet manufacturing method as set forth in claim 5, wherein the microfibrillated cellulose has a viscosity of 1,000 to 10,000 mPa·s, where 2% by weight of microfibrillated cellulose is mixed with 98% by weight of water.

7. A water-disintegratable sheet manufacturing method as set forth in claim 5, wherein a processing energy of each water jet treatment imparted to the fibrous web with a single row of water-jet nozzles arranged in CD is from 0.05 to 0.5 kw/m$^2$ and the water-jet treatment is performed 1 to 6 times.

8. A water-disintegratable sheet manufacturing method as set forth in claim 5, wherein before applying water jets, another fibrous web is prepared in a wet-laid process to have a different microfibrillated cellulose content and laid on the preceding fibrous web.

* * * * *